United States Patent [19]

Kai

[11] Patent Number: 4,951,799

[45] Date of Patent: Aug. 28, 1990

[54] METHOD OF CORRECTING COIN DATA AND APPARATUS FOR INSPECTING COINS

[75] Inventor: Osamu Kai, Tokyo, Japan

[73] Assignee: Tamura Electric Works, Ltd., Japan

[21] Appl. No.: 304,347

[22] Filed: Jan. 31, 1989

[30] Foreign Application Priority Data

Feb. 10, 1988 [JP] Japan ..... 63-27447

[51] Int. Cl.[5] ..... G07F 3/02

[52] U.S. Cl. ..... 194/317; 194/303; 209/571; 364/579

[58] Field of Search ..... 194/317, 318, 319, 303; 73/163; 209/571, 567, 570; 364/579, 582, 571.01–571.06; 324/236, 262

[56] References Cited

U.S. PATENT DOCUMENTS

| | | | |
|---|---|---|---|
| 4,538,719 | 9/1985 | Gray et al. | 194/317 |
| 4,556,140 | 12/1985 | Okada | 194/303 X |
| 4,572,349 | 2/1986 | Furuya et al. | 194/318 |
| 4,749,074 | 6/1988 | Ueki et al. | 194/317 |

FOREIGN PATENT DOCUMENTS

| | | | |
|---|---|---|---|
| 2646025 | 4/1978 | Fed. Rep. of Germany | 194/317 |
| 3714298 | 11/1987 | Fed. Rep. of Germany | 194/317 |
| 0004037 | 9/1985 | PCT Int'l Appl. | 194/317 |
| 1527450 | 10/1978 | United Kingdom | 194/317 |
| 2045500 | 10/1980 | United Kingdom | 194/318 |
| 2182477 | 5/1987 | United Kingdom | 194/317 |

*Primary Examiner*—Joseph J. Rolla
*Attorney, Agent, or Firm*—Remy J. VanOphem

[57] ABSTRACT

A method of correcting coin data and an apparatus for inspecting coins in which determination data is formed on the basis of data read out from a permanent memory, and authenticity and determination of coins are determined on the basis of the readout data. At the same time, maximum and minimum values corresponding to physical characteristics of coins are obtained. When the number of stored coins reaches a predetermined number or an operating time reaches a predetermined duration, the maximum and minimum values are updated. When such updating is performed a predetermined number of times, a standard deviation is also updated.

13 Claims, 5 Drawing Sheets

METHOD OF CORRECTING COIN DATA AND APPARATUS FOR INSPECTING COINS

BACKGROUND OF THE INVENTION

The present invention relates to a method of correcting coin data and an apparatus for inspecting coins, wherein data for discriminating authenticity and denominations of coins inserted in an automatic vending machine, a public telephone booth, and the like is corrected.

An inspection apparatus of this type is disclosed in U.S. Pat. No. 3,918,565. In this apparatus, physical characteristics, such as the thickness diameter and the like, of a coin are detected by detectors as electrical signals. Upper and lower limit values corresponding to detection outputs of the respective physical characteristics are stored in a memory. The upper and lower limit values are compared with the outputs from the detectors to determine authenticity and denomination of coins.

All data corresponding to all denominations (types) of coins and their physical characteristics and the corresponding upper and lower limit values must be read out from a memory, and detection outputs corresponding to the numbers of denominations and physical characteristics must be compared with the upper and lower limit values. For this reason, high-speed determination operations cannot be performed, and power consumption is increased. In addition, if these operations are performed by a processor, a program is complicated and a time margin for other control operations is decreased. Since high-speed determination operations cannot be performed, a determination time is prolonged. Therefore, a coin insertion time interval is limited, and design of coin paths is also limited.

In order to solve the above problems, an arrangement disclosed in U.S. Pat. No. 4,660,705 is proposed. In this arrangement, physical characteristic determination signals for coins are stored at bit positions corresponding to the denominations at addresses of a memory. The physical characteristics of coins are detected by detectors as electrical signals. These detection outputs are converted into digital signals by an A/D converter, and the digital signals are used as memory address signals, thereby using the contents of the memory as authenticity determination signals.

The conventional methods described above, however, must correct sensor outputs upon changes in environmental changes, and deterioration over time must also be corrected to result in a complex correction circuit. In addition, initialization must be performed at each installation site, resulting in poor operability.

SUMMARY OF THE INVENTION

It is, therefore, a principal object of the present invention to provide a method of correcting coin data and an apparatus for inspecting coins, wherein environmental changes such as a change in coin discrimination path, a change in sensor characteristic, a change in coin, and a change in sensor circuit performance can be automatically compensated.

According to an aspect of the present invention, there is provided a method of correcting coin data used in a coin inspecting apparatus in which an electrical signal representing a detection parameter as one of physical characteristics of a coin used is detected, the electrical signal is converted into digital data, and authenticity and a denomination of the coin for the physical characteristic corresponding to the detection parameter are determined. Maximum and minimum values are determined from first reference data consisting of a reference average value and a standard deviation of the physical characteristic corresponding to the detection parameter of an authentic coin. Authenticity of an inserted coin is determined on the basis of the maximum and minimum values and data associated with the authentic coin is stored as a result of a determination. An average value from the stored data associated with the authentic coin is calculated when a predetermined measurement parameter reaches a value, and a new average value of an authentic coin to be inspected next is calculated by using the average value and the reference average value of the first reference data. A corrected maximum value and a corrected minimum value of the authentic coin to be inspected next are determined by using the new average value and the standard deviation of the first reference data.

According to another aspect of the present invention, there is provided an apparatus for inspecting coins in which an electrical signal representing a detection parameter as one of the physical characteristics of a coin used is detected, the electrical signal is converted into digital data, and authenticity and a denomination of the coin for the physical characteristic corresponding to the detection parameter are determined. The apparatus includes maximum/minimum value calculating means for obtaining maximum and minimum values from first reference data consisting of a reference average value and a standard deviation of the physical characteristic corresponding to the detection parameter of an authentic coin, authenticity determining means for determining authenticity of an inserted coin on the basis of the maximum and minimum values, data storing means for storing data associated with the authentic coin as a result of a determination, average value calculating means for calculating an average value from the stored data associated with the authentic coin when a predetermined measurement parameter reaches a value, and for calculating a new average value of an authentic coin to be inspected next by using the average value and the reference average value of the first reference data, and maximum/minimum value correcting means for determining a corrected maximum value and a corrected minimum value of an authentic coin to be inspected by using the new average value and the standard deviation of the first reference data.

According to the present invention, determination data is formed on the basis of data read out from a permanent memory, and coins are determined on the basis of the readout data. At the same time, maximum and minimum values corresponding to physical characteristics of coins are obtained. When the number of stored coins reaches a predetermined number or an operating time reaches a predetermined duration, the obtained values are updated. In addition, when such updating is performed a predetermined number of times, standard deviations are also updated.

DETAILED DESCRIPTION OF THE PREFERRED EMBODIMENT

Figure 4:
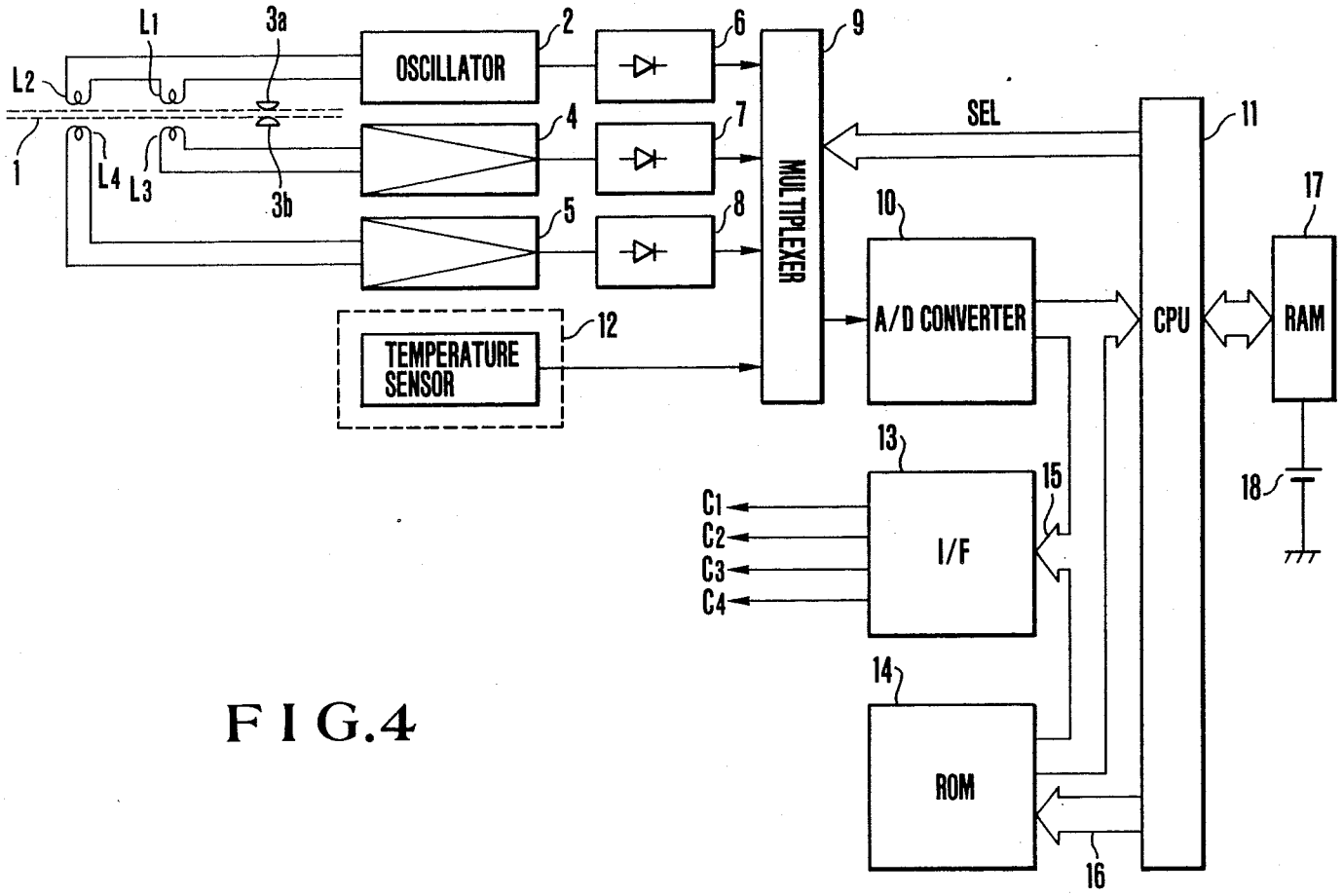
FIG. 4 is a block diagram showing the embodiment to which the present invention is embodied.

FIG. 4 shows an arrangement of an apparatus for inspecting coins according to an embodiment of the present invention. Oscillation coils $L_1$ and $L_2$ oppose reception coils $L_3$ and $L_4$ through a coin path 1. An oscillator 2 is connected to the oscillation coils $L_1$ and $L_2$. The oscillator 2 generates a signal having a predetermined frequency. A magnetic field formed by the oscillation coils $L_1$ and $L_2$ in response to the signal from the oscillator 2 is received by the reception (oscillation) coils $L_3$ and $L_4$. Detectors 3*a* and 3*b* which respectively consist of a light-emitting element and a light-receiving element are arranged on a coin slot side of the path 1 to detect insertion of a coin and supply a start command to the respective components.

The reception coils $L_3$ and $L_4$ are connected to inputs of amplifiers 4 and 5, respectively. Inputs to the oscillator 2 and the amplifiers 4 and 5 are detected by detectors 6 to 8, respectively. One of the detected signals is selected by a multiplexer 9. The signal selected by the multiplexer 9 is supplied to an A/D converter 10. The selected signal can be sequentially converted into an 8-bit digital signal. The 8-bit digital signal is supplied to a CPU 11.

For this reason, when a coin inserted into the path 1 passes along the path 1, outputs from the oscillator 2 and the amplifiers 4 and 5 are changed in accordance with its material, thickness, and diameter. Outputs from the detectors 6 to 8 are changed accordingly. Of signals output through the A/D converter 10, a peak value of a signal corresponding to the detector 6 is discriminated by the CPU 11, thereby obtaining data representing the material of the coin. A peak value of a signal corresponding to the detector 7 is similarly discriminated to obtain data representing the thickness of the coin. A value at a crossing point of the changes in outputs from the detectors 7 and 8 is similarly discriminated to obtain data representing the diameter of the coin.

Detection of these physical characteristics is disclosed in detail in "Coin Discrimination Apparatus" (Japanese Patent Application No. 59-76620) filed by the present applicant. A detection output from a temperature sensor 12 arranged near the coils $L_1$ to $L_4$ is also supplied to the multiplexer 9 as needed. The respective inputs to the multiplexer 9 are sequentially and repetitively selected by a selection signal SEL from the CPU 11. The selected signal is supplied to the CPU 11 through the A/D converter 10. The CPU 11 is connected to an input/output interface 13 and a ROM 14 through a single data bus 15. Denomination signals C1 to C4 which represent coin determination results are input to the CPU 11 through the interface 13. The contents of the ROM 14 are read out by an address designation signal supplied from the CPU 11 through an address bus 16.

Coin physical characteristic determination signals are stored together with programs in the ROM 14. A RAM 17 backed up by a battery 18 is also arranged. The CPU 11 executes the programs stored in the ROM 14 and accesses necessary data with respect to the RAM 17, thereby performing predetermined operations to be described later.

Figure 5:
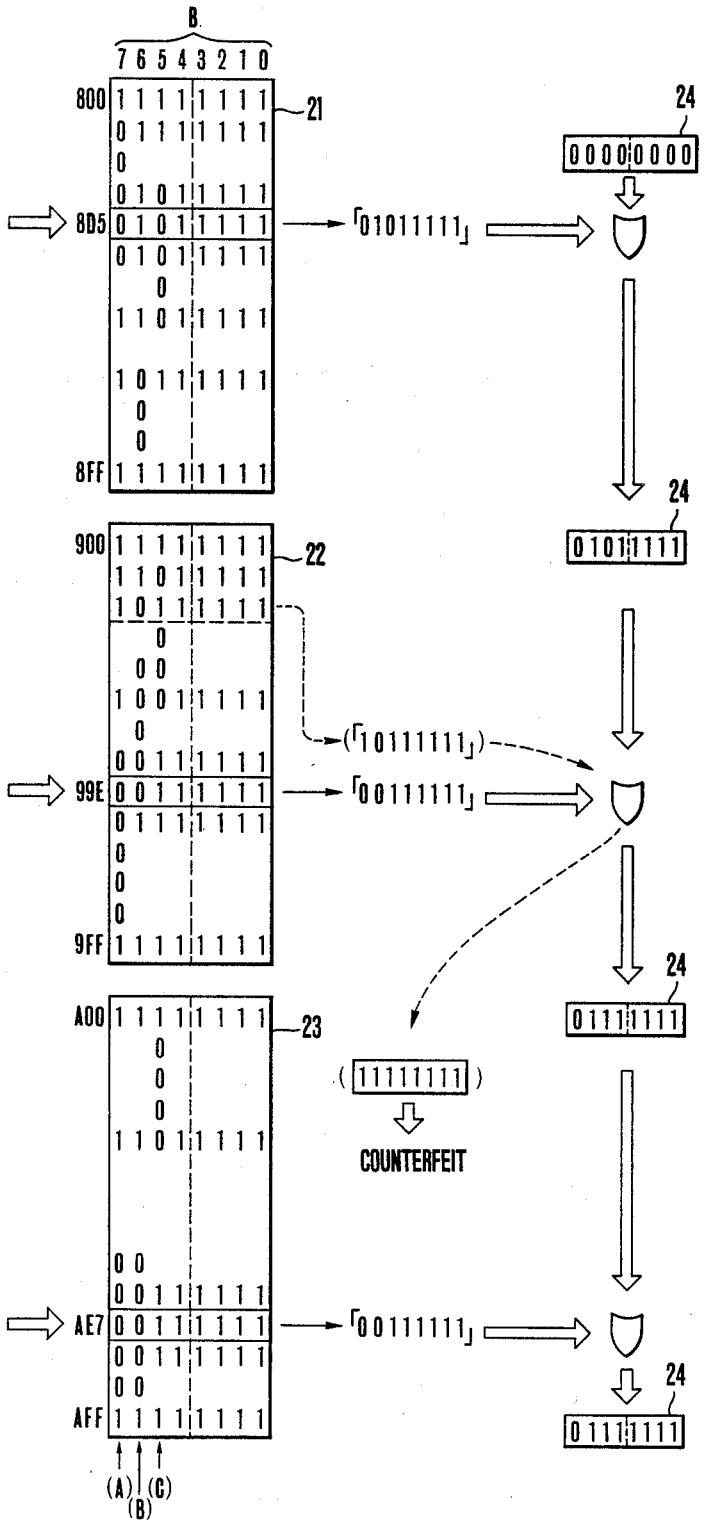
FIG. 5 is a data table of a memory.

FIG. 5 shows contents of the ROM 14 and the contents of a denomination data are allocated in the RAM 17. In the ROM 14, addresses 800 (hexadecimal notation) to 8FF are assigned to a material block 21; addresses 900 to 9FF, to a thickness block 22; and addresses A00 to AFF, to a diameter block 23. Bits $B_7$ to $B_5$ of bits $B_7$ to $B_0$ correspond to denominations A to C of coins. A logic "0" signal is stored at an address represented by each physical characteristic detection data. A logic "0" signal is stored at an address represented by detection data of each physical characteristic allowance range.

Since the material and thickness data partially overlap due to the allowance regardless of coin denominations A to C in the blocks 21 and 22, logic "0" signals are stored in the blocks 21 and 22 in the same manner as described above. The diameter allowances of the coin denominations in the block 23 are the same, so that logic "0" signals are stored in the same manner as described above.

Of the output data from the A/D converter 10 which correspond to the detection outputs from the coils $L_1$ to $L_4$ used as the detectors, the material data obtained by the CPU 11 is used to designate a read address of the block 21. When the diameter data is used to designate a read address of the block 23, the corresponding contents are read out from the ROM 14 and are sent to the CPU 11.

If the output from the A/D converter 10 is given as an 8-bit signal, the two lower hexadecimal digits of addresses 800 to AFF are designated, and upper hexadecimal digits 8, 9, and A correspond to the blocks 21 to 23, respectively. Therefore, the CPU 11 adds predetermined information to this address data, and the resultant data is sequentially sent through the address bus 16.

For example, if the material data, the thickness data, and the diameter data are given as D5 ("11010101"), 9E ("10011110"), and E7 ("11100111"), respectively, addresses 8D5, 99E, and AE7 of the blocks 21, 22, and 23 are accessed, so that the data contents "01011111", "00111111", and "00111111" are sequentially read out, respectively. The content of a denomination data area 24 is cleared to all "0"s. This updated content is logically ORed with the content of the block 21. The OR product is then written in the denomination data area 24. This OR product is then ORed again with the content of the block 22. The current content of the denomination data area 24 is updated by this resultant OR product. Similarly, the current content of the denomination data area 24 is logically ORed with the content of the block 23, and the resultant product is stored in the denomination data area 24. In the above case, bits $B_7$ of all the blocks 21 to 23 are "0"s, respectively, so that bit $B_7$ of the denomination data area 24 is set to be logic "0" accordingly. Therefore, each physical characteristic is determined to be allowable as one for the denomination A.

When the denomination signals $C_1$ to $C_4$ are output through a decoder or the like, a denomination of a coin inserted through a coin slot can be immediately detected.

If the content "10111111" shown in parentheses is read out from the block 22 due to wrong addressing, the content of the denomination data area 24 is updated to "11111111". Logic "0" disappears from the content of the denomination data area 24, so that the inserted coin is a counterfeit coin, thus indicating "NG", i.e., a message representing that the inserted coin cannot be allowed.

Figure 1:
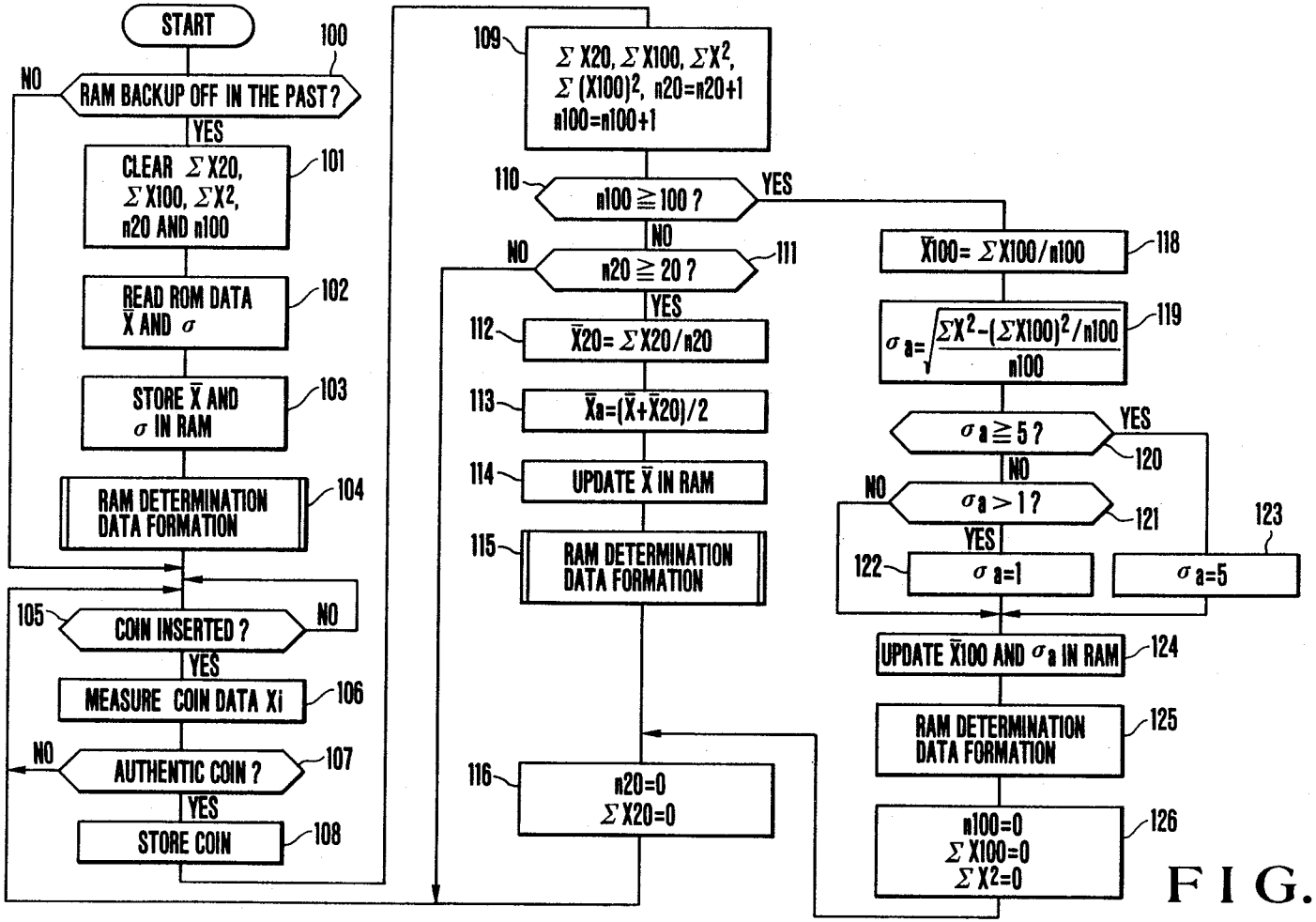
FIG. 1 is a flow chart showing a main routine according to an embodiment of the present invention.

FIG. 1 is a flow chart showing the above operations of the CPU 11. When the program starts or runs, a backup state of the RAM 17 is checked in step 100 to determine whether the RAM backup is in the past. This can be determined such that a key word is written in a RAM and checked whether it is accurately read out at the start of the program. If YES in step 100, there is a high possibility of destruction of the determination data. Coin data addition memories ($\Sigma$x20 and $\Sigma$x100), square addition memory ($\Sigma x^2$), and coin count memories (n20 and n100) which determine authentic ones of the coins inserted in the coin slot are cleared up in step 101. In step 102, an average value $\bar{x}$ and a standard deviation $\sigma$ as data associated with an authentic coin are read out from the ROM 14. The readout data are stored in the RAM 17 in step 103. Thereafter, RAM determination data, i.e., maximum and minimum values $\bar{x}\pm3\sigma$ are obtained by using the readout data $\bar{x}$ and $\sigma$ in step 104, thereby setting the determination data. It should be noted that the operation in step 104 is actually executed in a subroutine in FIG. 2, and a description of the subroutine will be made after the description of FIG. 1 is completed.

When formation of the RAM determination data is completed in step 104, coin insertion is determined in step 105. In step 106, data (i.e., material, diameter, and thickness) of an inserted coin are measured. It is then determined in step 107 whether the inserted coin is an authentic coin. If YES in step 107, the authentic coin is stored in step 108. In step 109, the addition memories ($\Sigma$x20 and $\Sigma$x100) are incremented in step 109. A squared value of the measured data is added to the square addition memories ($\Sigma x^2$ and $\Sigma(x100)^2$). The coin count memories (n20 and n100) are incremented by one each.

It is then determined in step 110 whether the number of authentic coins is 100. At this time, the number of authentic coins does not reach 100, and NO is obtained in step 110. When the number of authentic coins reaches 20, YES is obtained in step 111. An average value $\bar{x}$20 is obtained from the addition memory $\Sigma$x20 and the coin count memory n20 in step 112. A new average value $\bar{x}_a$ is obtained from the average value data $\bar{x}$ stored in the ROM 17 and the average value $\bar{x}$20 of 20 authentic coins in step 113. The average value $\bar{x}$ of the RAM 17 is updated to the value $\bar{x}_a$ in step 114. The RAM determined data, i.e., the average value $\bar{x}_a$ is read out from the ROM 14 and the standard deviation $\sigma$ is read out from the RAM 17. By using these readout data, determination data $\bar{x}_a\pm3\sigma$ is obtained by the subroutine in FIG. 2, thereby constituting a determination data table. Therefore, the authentic coin range is shifted to a range suitable for the inserted authentic coins. However, the range width is kept unchanged. When this processing is completed, the coin count memory n20 and the average value memory $\Sigma$x20 are cleared in step 116, and the flow returns to step 105.

When additional coins are inserted through the coin slot and the number of authentic coins reaches 100, YES is obtained in step 110. An average value $\bar{x}$100 is obtained by data from the addition memory $\Sigma$x100 and the coin count memory n100 in step 118. In step 119, a new standard deviation $\sigma_a$ is obtained by data from the square addition memory $\Sigma x^2$, the addition memory x100, and the coin count memory n100. The resultant value is limited to fall within a predetermined range, e.g., the range of 1 to 5 so as to prevent a discrimination error in steps 120 to 123. In step 124, the standard deviation and the average value in the RAM 17 are updated to the values obtained in steps 118 and 119, respectively. By using the new data, the RAM determination data, i.e., $\bar{x}_a\pm3\sigma_a$ are obtained in step 125. A new determination data table is formed by the subroutine in FIG. 2. Thereafter, the coin count memory n100, the addition memory $\Sigma$x100, and the square addition memory $\Sigma x^2$ are cleared in step 126. In step 116, the memories n20 and $\Sigma$x20 are cleared, and the flow then returns to step 105.

Figure 2:
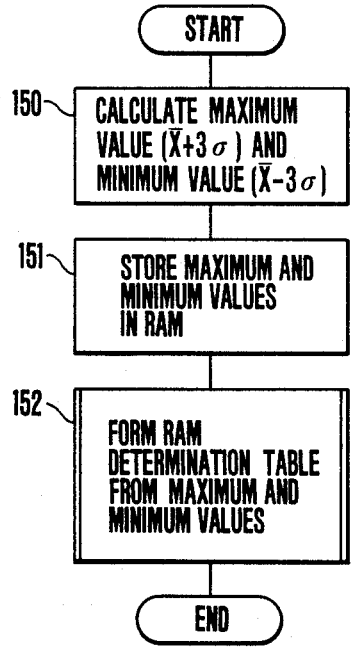
FIGS. 2 and 3 are flow charts showing subroutines of the flow chart in FIG. 1.

FIG. 2 is a subroutine for forming the RAM determination data in steps 104, 115, and 125. The maximum value $\bar{x}+3\sigma$ and the minimum value $\bar{x}-3\sigma$ are calculated in step 150. The calculated maximum and minimum values are stored in the RAM in step 151. A RAM determination data table is formed by using the maximum and minimum values in step 152. Step 152 is executed by a subroutine shown in FIG. 3.

Figure 3:
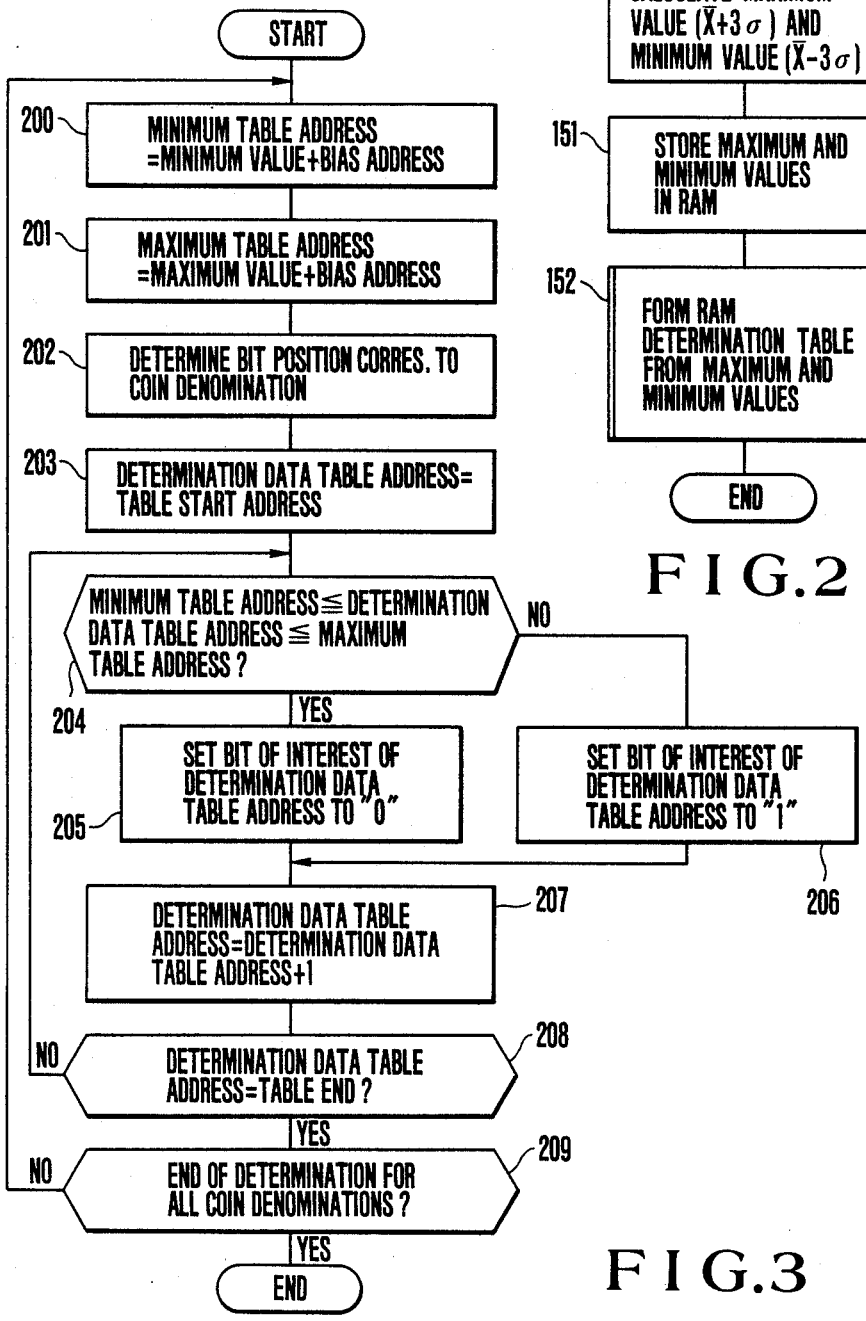

FIG. 3 is a flow chart for forming the RAM determination table represented by the blocks 21 to 23 (left side of FIG. 5). In step 200, a sum of the minimum value and a bias address is set as a minimum table address. The bias addresses are the most significant digits "8", "9", and "A" in the blocks 21, 22, and 23 in FIG. 5, respectively.

A sum of the maximum value and a bias address is set as a maximum table address in step 201. In step 202, a coin denomination bit position is set. That is, one of the positions of bits 5, 6, and 7 in FIG. 5, i.e., any one of bits for denominations A, B, and C is designated. In step 203, the determination data table address is set to be, e.g., address 800 for the block 21.

It is determined in step 204 whether the current determination data table address is equal to or larger than the minimum data table address and is equal to or smaller than the maximum table address. This is performed to determine an allowable address range for authentic coin data. If NO in step 204, the bit of interest of the determination data table address is set to be "1" in step 206. Memory areas at addresses 800, 900, and A00 of the blocks 21, 22, and 23 do not represent authentic coin ranges. "1"s are written at bits 5 to 7 in each of the blocks 21, 22, and 23. However, if the bit of interest at address 800 is bit 7, only this bit is set at logic "1" because the address is the table start address.

A value obtained by adding the determination data table address by one is given as a new determination data address in step 207. In step 208, it is determined whether the new determination data table address is a table end. At this moment, the current address is obtained by adding one to the table start address and is not a table end address. NO is obtained in step 208, and the flow then returns to step 204. Decision in step 204 is performed to repeat the same operations as described above. If YES in step 204, the bit of interest of the determination data table is set to "0" in step 205. For example, bit 7 of the block 21 at address 801 is set to "0". The loop of steps 204 to 208 is repeated until the determination data table address coincides with the table end address, e.g., address 8FF for the block 21. At this time, since YES is obtained in step 208, the flow advances to step 209. It is determined in step 209 whether operations for all denominations are completed. In this case, only the operation for one denomination, i.e., for the block 21 is completed, and the flow returns to step 200. The same operation as described above is repeated. Data for the next coin denomination, e.g., the block 22 is written.

When processing progresses, operations for all coin denominations are completed. YES is obtained in step 209, and this subroutine is completed. The flow returns to step 152 in FIG. 2. The subroutine in FIG. 2 is also ended. At this time, the flow returns to step 104, 115 or 125 (FIG. 1) at which an interrupt is formed.

Figure 6A:
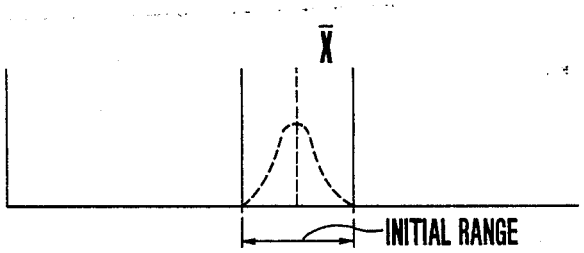
FIGS. 6A to 6F are views showing states of changes in authentic coin determination data.
Figure 6B:
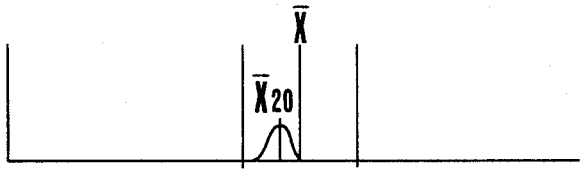
Figure 6C:
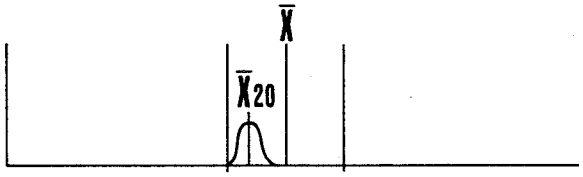
Figure 6D:
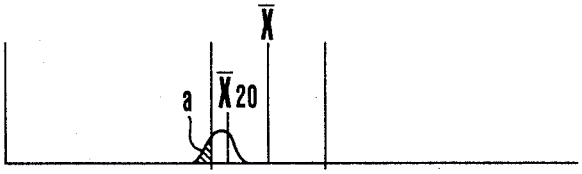
Figure 6E:
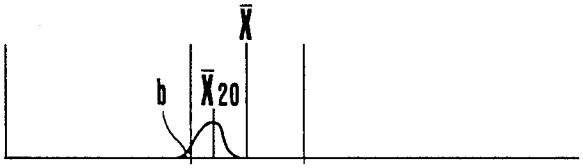
Figure 6F:
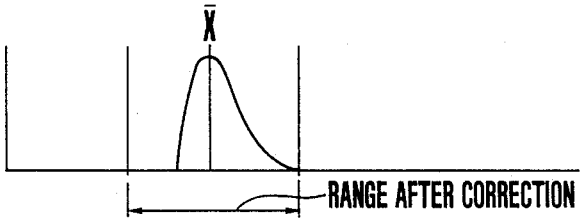

FIGS. 6A to 6F show changes in authentic coin ranges when processing by the method of the present invention is performed. FIG. 6A shows an initial state, FIG. 6B shows a state in which the number of coins determined to be authentic coins reaches 20, FIG. 6C shows a state in which 20 additional authentic coins are increased, so that a total number of authentic coins reaches 40, FIG. 6D shows a state in which a total number of authentic coins reaches 60, FIG. 6E shows a state in which a total number of authentic coins reaches 80, and FIG. 6F shows a state in which a total number of authentic coins reaches 100. Letters a and b, respectively in FIGS. 6D and 6E represent returned coins. The authentic coins are counted independently of the number of calls.

The RAM determination data are formed in steps 104, 115, and 125 and are addressed in accordance with the material block 21, the thickness block 22, and the diameter block 23 in FIG. 5. For this reason, the bias addresses are respectively added to the data obtained in steps 104, 115, and 125 and are assigned to predetermined address locations.

In the above embodiment, the predetermined number is 20, and an integer of an integer multiple of the predetermined number is 5. However, these values are not limited to 20 and 5 times. For example, an integer of a multiple may be replaced with a noninteger, e.g., 5.3. The variation range is given by $3\sigma$ but may be replaced with $4\sigma$. In addition, an object to be stored is not limited to a coin. The predetermined number may be the predetermined number of coins or calls. In addition, the predetermined number may be replaced with a predetermined time. Updating of the average value and the standard deviation may be performed every predetermined number of coins. Alternatively, this method may be applied to the upper/lower limit value scheme (Mars scheme) in addition to the determination table scheme.

According to the present invention as has been described above, the determination data is updated in accordance with the data of the stored objects every time the number of stored objects reaches a predetermined number or the operation time of the machine reaches a predetermined duration. Therefore, the environmental changes such as a change in discrimination path, a change in sensor, a change in object, and a change in sensor circuit can be automatically compensated.

What is claimed is:

1. A method for correcting data used in a coin inspecting apparatus in which data representing at least one physical characteristic of an inserted coin is generated and used to determine the authenticity of the inserted coin comprising the steps of:

obtaining maximum and minimum values for said at least one physical characteristic representing authentic coins from reference data consisting of a reference average value for said at least one physical characteristic and a reference standard deviation of said at least one physical characteristic;

comparing said data generated by coins inserted into said coin inspecting apparatus with said maximum and minimum values to determine the authenticity of said inserted coin;

storing said data for each inserted coin determined to be authentic;

calculating an average value of said stored data each time a first predetermined measurement parameter is detected;

calculating a new reference average value from said average value calculated from said data and said reference average value;

generating said maximum and minimum values from said new reference average value and said reference standard deviation for determining the authenticity of said coins inserted after said first predetermined measurement parameter is detected;

calculating a new standard deviation from said stored data each time a second predetermined measurement parameter is detected; and generating said maximum and minimum values from said new reference average value and said new standard deviation for determining the authenticity of said coins inserted in said coin inspecting apparatus after said second predetermined measurement parameter is detected.

2. A method according to claim 1, wherein said reference data prior to the detection of said first predetermined measurement parameter is data prestored in a memory as initial reference data.

3. A method according to claim 1, wherein said new reference average value is stored in a memory.

4. A method according to claim 1, wherein said first predetermined measurement parameter is the number of inserted coins determined to be authentic in said step of comparing.

5. A method according to claim 1, wherein said first predetermined measurement parameter is an operating time of said coin inspecting apparatus.

6. A method according to claim 1, wherein said second predetermined measurement parameter is a predetermined integer multiple of said first predetermined measurement parameter.

7. A method according to claim 1, wherein said new standard deviation is limited to a predetermined range.

8. A method according to claim 1, wherein said step of comparing uses said data to address a determination data table, said method further comprising the steps of:

generating maximum and minimum addresses for said determination data table by adding predetermined bias addresses to said maximum and minimum values, respectively; and forming said determination data table by setting a bit logic of a predetermined bit position to be an allowable bit identifying authentic coins between said maximum and minimum addresses.

9. A method according to claim 8, wherein said coin inspecting apparatus inspects coins of different denomination, said determination data table is formed by generating said maximum and minimum addresses from said maximum and minimum values corresponding to each denomination of the coin being inspected so that an allowable bit at each bit position corresponding to an authentic coin for each denomination of the coin between said maximum and minimum addresses is set.

10. A method according to claim 8, wherein said coin inspecting apparatus generates data representing at least two different physical characteristics, said determination data table is formed in units of physical characteristics by adding different bias addresses to said maximum and minimum values corresponding to said at least two physical characteristics of the coin.

11. An apparatus for inspecting coins in which electrical data representing a physical characteristic of said coins is generated and used to determine the authenticity of each of said coins comprising:

calculating means for generating maximum and minimum values from a reference average value and a reference standard deviation of said physical characteristic of said coins;

means for comparing said data representing said physical characteristic with said maximum and minimum values to determine the authenticity of each coin inserted into said apparatus;

means for storing said data for each of said inserted coins determined to be authentic;

means for averaging said stored data each time a first predetermined measurement parameter is detected to generate an average value of said stored data;

means for generating a new reference average value from said average value of said stored data and said reference average value;

storing said new reference value as said reference value to be used by said calculating means for generating said maximum and minimum values;

means for generating a new standard deviation from said stored data each time a second predetermined measurement parameter is detected; and storing said new standard deviation as said reference standard to be used by said calculating means for generating said maximum and minimum values.

12. An apparatus according to claim 11, further comprising a determination data table addressed by said data and means for generating maximum and minimum addresses to said determination data table by adding predetermined bias addresses to said maximum and minimum values, respectively, and for setting a bit logic of a predetermined bit position to be an allowable bit for all addresses of said determination data table between said maximum and minimum addresses.

13. A method of correcting data used in a coin inspecting apparatus in which data representing a physical characteristic of an inserted coin is generated and from said data the authenticity of the inserted coin is determined comprising the steps of:

comparing said data representing a physical characteristic of an inserted coin with a maximum value and a minimum value to determine the authenticity of the inserted coin;

storing said data for each coin inserted into said coin inspecting apparatus determined to be authentic;

calculating an average value for said physical characteristic from said stored data each time a first predetermined measurement is detected;

calculating a standard deviation for said physical characteristic from said stored data each time a second predetermined measurement is detected; and generating said maximum value and said minimum value of said physical characteristic of an authentic coin from said average value and said standard deviation.

* * * * *

UNITED STATES PATENT AND TRADEMARK OFFICE

CERTIFICATE OF CORRECTION

PATENT NO. : 4,951,799

DATED : August 28, 1990

INVENTOR(S) : Osamu Kai

It is certified that error appears in the above-identified patent and that said Letters Patent is hereby corrected as shown below:

Column 5, line 15, delete "up".

Column 5, line 47, delete "ROM" and insert ---- RAM ----.

Signed and Sealed this

Twenty-eighth Day of April, 1992

*Attest:*

HARRY F. MANBECK, JR.

*Attesting Officer*

*Commissioner of Patents and Trademarks*